United States Patent [19]

Mori et al.

[11] Patent Number: 5,027,614

[45] Date of Patent: Jul. 2, 1991

[54] L-SHAPED ONE-PACKAGE TYPE AIR CONDITIONER AND A BRACKET FOR INSTALLING THE SAME

[75] Inventors: Soji Mori, Moriyama; Tatuhiro Kobayashi, Kusatsu, both of Japan

[73] Assignee: Matsushita Electric Industrial Co., Ltd., Osaka, Japan

[21] Appl. No.: 408,658

[22] Filed: Sep. 18, 1989

[30] Foreign Application Priority Data

Sep. 19, 1988 [JP] Japan ..... 63-233926

[51] Int. Cl.[5] ..... F25D 23/12

[52] U.S. Cl. ..... 62/262; 62/263

[58] Field of Search ..... 62/262, 263

[56] References Cited

U.S. PATENT DOCUMENTS

| | | | |
|---|---|---|---|
| 2,436,713 | 2/1948 | Cody | 62/262 X |
| 2,753,699 | 7/1956 | Gannon | 62/262 |
| 2,810,335 | 10/1957 | Bilgrei | 62/262 X |
| 2,891,754 | 6/1959 | Kuhlenschmidt et al. | 62/262 X |
| 3,208,236 | 9/1965 | Frigerio | 62/262 |
| 3,548,611 | 12/1970 | Ulich | 62/262 |
| 3,602,006 | 8/1971 | Metcalfe | 62/262 |
| 3,860,206 | 1/1975 | Wenig | 62/262 X |

*Primary Examiner*—Lloyd L. King

*Attorney, Agent, or Firm*—Panitch Schwarze Jacobs & Nadel

[57] ABSTRACT

An L-shaped one-package type air conditioner comprising an air circuit unit which extends horizontally to be positioned indoors, and an outdoor unit which extends downwardly from the rear end portion of the air circuit unit is provided with an elongate member protruding downwardly from the lower surface of the air circuit unit, and with two projections. A bracket for installing the air conditioner is also disclosed. The bracket comprises: a fixing portion which engages with a window frame; an upper guiding portion extending horizontally; and a lower guiding portion extending vertically. The projections are guided by the upper and lower guiding portions.

12 Claims, 5 Drawing Sheets

L-SHAPED ONE-PACKAGE TYPE AIR CONDITIONER AND A BRACKET FOR INSTALLING THE SAME

BACKGROUND OF THE INVENTION

1. Field of the Invention

This invention relates to an L-shaped one-package type air conditioner and a bracket for installing the air conditioner on a window frame or the like.

2. Description of the Prior Art

Among one-package type air conditioners which can be installed on a window frame of a building, an L-shaped one has been proposed (e.g., Japanese Patent Publication (Kokoku) No. 47(1972)-24222). In such an L-shaped one-package type air conditioner (hereinafter, referred to as merely "an air conditioner"), an air circuit unit extends horizontally from the top of an outdoor unit in which a motor and a compressor are accomodated.

When installing such an air conditioner on a window frame of a building, it is difficult to install it from the indoor side because of its unique structure. Therefore, the installation of an air conditioner to a window frame has been conducted from the outdoor side in the case where the window frame is not so high from the ground. It has been desired to develop an air conditioner which is easy to install from the outdoor side.

In contrast, when an air conditioner is installed in a high-rise building, it must be installed from the indoor side in spite of the difficulty in the installation. In the case that an air conditioner is installed on a window frame from the indoor side, there is danger that it may slip off the window frame and drop outside. Hence, it has been eagerly desired to take safety measures for preventing such an accident. Even if an air conditioner does not drop off a window frame, it is sometimes that a hand of the worker is pinched by the body of an air conditioner.

Moreover, it is often that the installation of an air conditioner is compelled to be performed by one person. Generally, this work is not an easy one.

When an air conditioner has been once installed on a window frame, it is difficult to adjust the degree of its tilt, which is necessary to drain water from either side wall.

SUMMARY OF THE INVENTION

The one-package type air conditioner of this invention, which overcomes the above-discussed and numerous other disadvantages and deficiencies of the prior art, comprises an air circuit unit which extends horizontally to be positioned indoors, and an outdoor unit which extends downwardly from the rear end portion of said air circuit unit, the improvement exists in that an elongate member is attached to said air circuit unit, said elongate member protruding downwardly from the lower surface of said air circuit unit.

In a preferred embodiment, the air conditioner is to be mounted on a window frame, and said elongate member engages with a lower portion of the window frame.

In a preferred embodiment, the air conditioner comprises at least two engagement members which are attached to a side wall of said outdoor unit and protrude horizontally, said side wall being at the side of said fixing portion.

In a preferred embodiment, the engagement members having an enlarged top end.

In a preferred embodiment, the air conditioner comprises an engagement members which is attached to each of side walls of said outdoor unit and protrudes horizontally, said side walls facing to each other.

In a preferred embodiment, the engagement members having an enlarged end.

In a preferred embodiment, the air conditioner further comprises at least two elongate pads which are attached on said side wall, said elongate members being disposed respectively over said engagement members.

In a preferred embodiment, the elongate pads are made of synthetic rubber.

The bracket comprises a fixing portion which engages with a window frame; a lower guiding portion which extends vertically; an upper guiding portion which is disposed between said fixing portion and the upper end of said lower guiding portion; and at least two adjusting means which are attached to said lower guiding portion to protrude horizontally therefrom, the degree of the protrusion of said adjusting means being adjustable.

In a preferred embodiment, the bracket further comprises two regulation plates which protrude upwardly from each of both side ends of said fixing portion.

In a preferred embodiment, the upper guiding portion and said lower guiding portion are connected by a connecting portion having an arc-like section.

In a preferred embodiment, the rails are disposed at the outer side edges of said upper guiding portion, connecting portion and lower guiding portion, said rails having a reverse-L section and opposing to each other.

In a preferred embodiment, the upper guiding portion, connecting portion and lower guiding portion are composed of a pair of rails which are separated to each other by a predetermined distance, thereby forming said portions into one body.

In a preferred embodiment, two guiding pieces are disposed at the front end of said upper guiding portion, each of said guiding pieces protruding upwardly from the upper face of said upper guiding portion and facing respectively to said regulation plates, the distance between one of said guiding pieces and the corresponding one of said regulation pieces being gradually narrowed.

Thus, the invention described herein makes possible the objectives of (1) providing an L-shaped one-package type air conditioner which can be easily installed; (2) providing an L-shaped one-package type air conditioner which will not fall off from a bracket; (3) providing an L-shaped one-package type air conditioner which can be installed by one person; (4) providing an L-shaped one-package type air conditioner which can be safely installed; (5) providing a bracket for mounting an L-shaped one-package type air conditioner which can facilitate the installation of the air conditioner; (6) providing a bracket for mounting an L-shaped one-package type air conditioner which can prevent the air conditioner from falling off from the bracket during the installation of the air conditioner; (7) providing a bracket for mounting an L-shaped one-package type air conditioner by which an air conditioner can be safely installed; and (8) providing a bracket for mounting an L-shaped one-package type air conditioner which can easily adjust the tilt of the air conditioner after it has been installed.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
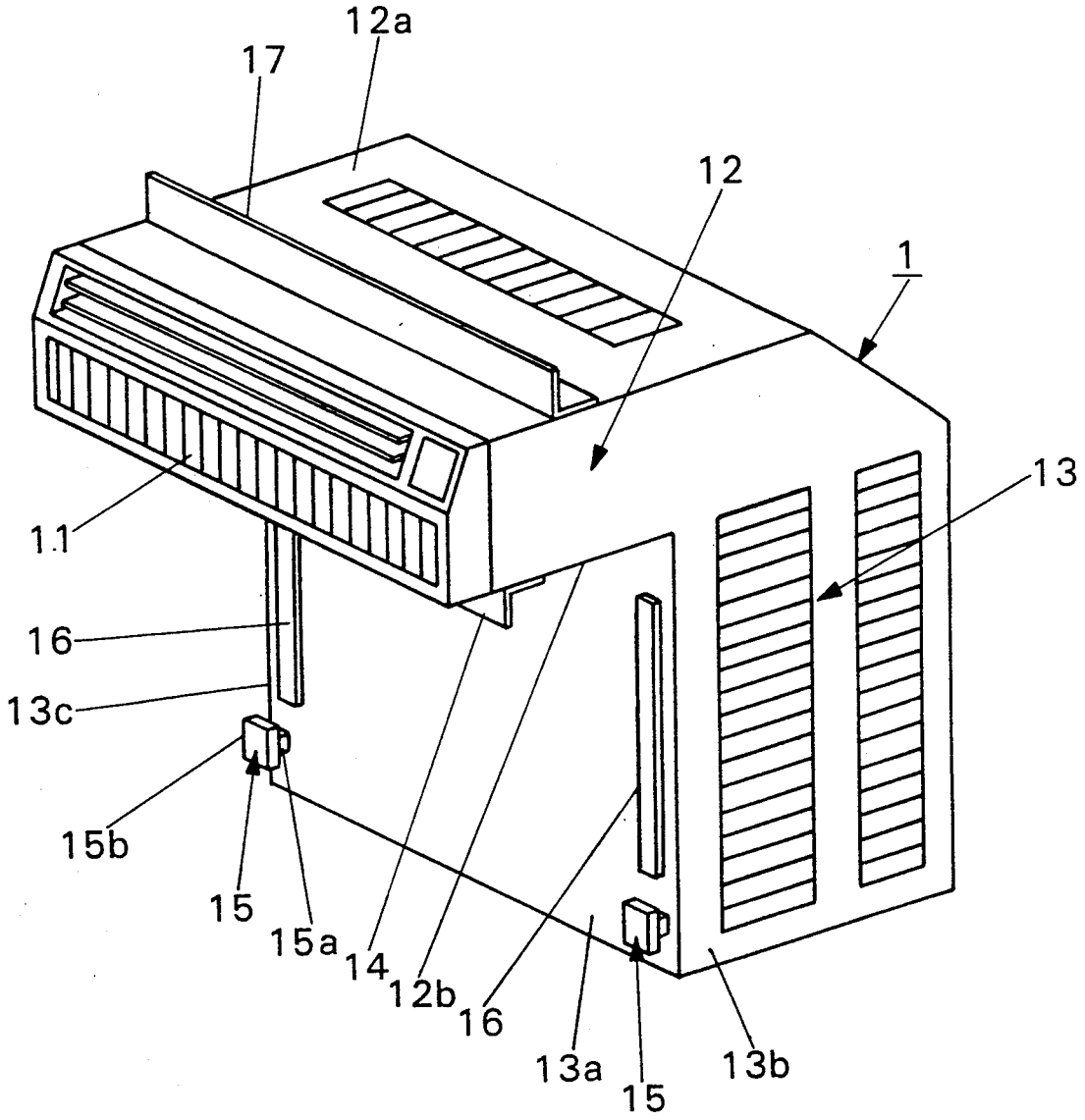
FIG. 1 is a perspective view of an air conditioner according to the invention.

FIG. 1 shows an air conditioner according to the invention. The air conditioner of FIG. 1 is designed so that it can be installed on a window frame, and comprises a body 1 which is composed of an air circuit unit 12 and an outdoor unit 13. The air circuit unit 12 has a box-like shape, the front end of which is formed into a grill through which air outlets and enters. The rear end of the air circuit unit 12 is connected to the top of the outdoor unit 13 which also has a box-like shape, so that the body 1 has a generally L-shaped section. An engagement member 14 made of an angle iron is fixed to the lower face 12*b* of the air circuit unit 12, and another engagement member 17 is attached to the upper face 12*a* of the air circuit unit 12. The engagement member 17 will be engaged with a lower end of a sash window after the installation of the air conditioner, thereby preventing rain and wind from entering indoors.

At the vicinity of the lower end of a side wall 13*a* of the outdoor unit 13 which is situated in the side of the air circuit unit 12, two engagement projections 15 are disposed. The projections 15 have a rectangular shaft portion 15*a* which protrudes from the side wall 13*a*. The free end of the shaft portion 15*a* is formed into an enlarged end 15*b*. Two strip-like brake pads 16 are fixedly attached on the side wall 13*a* so that they elongate vertically over the two shaft portions 15*a*, respectively. It is preferable to compose the brake pads 16 by a material having a large coefficient of friction such as synthetic rubber.

Figure 6:
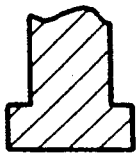
FIG. 6 illustrates the manner of temporarily installing the air conditioner of FIG. 1 onto a window frame.
Figure 6:
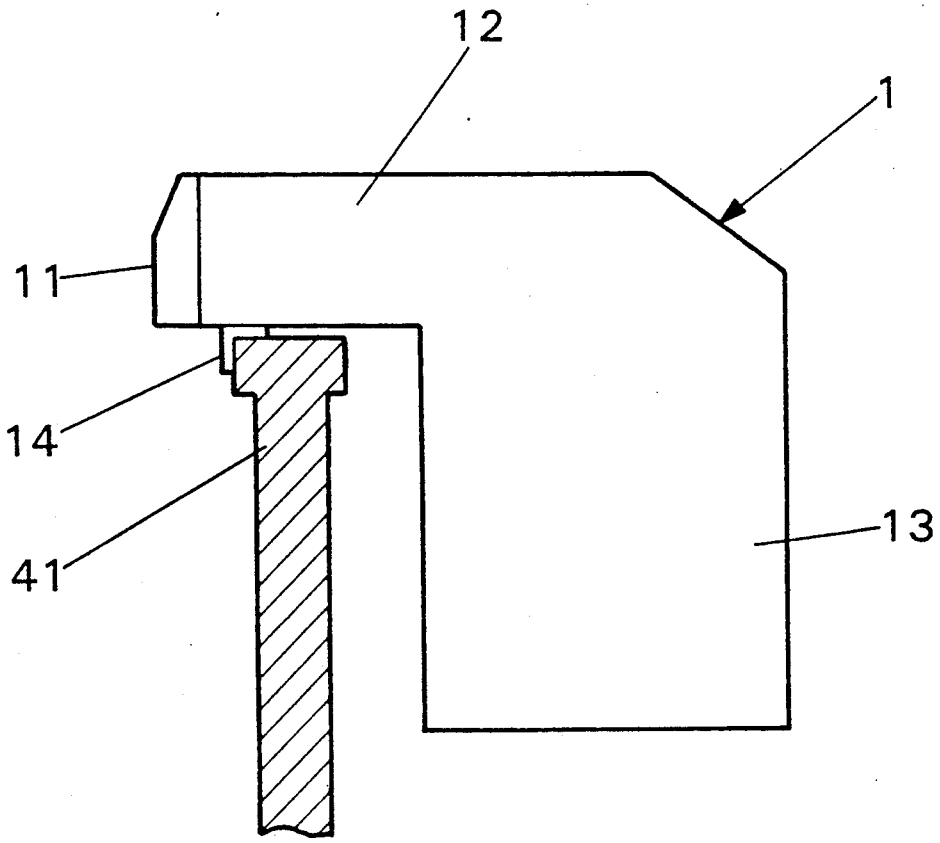

FIG. 6 illustrates the manner of temporarily installing the air conditioner of FIG. 1 on a window frame. When the body 1 of the air conditioner is placed on a window frame 41, as shown in FIG. 6, the body 1 is engaged with the indoor side of the window frame 41 by the engagement member 14, thereby preventing the air conditioner from falling off from the window frame even if the worker takes his hands off the body 1. Therefore, the air conditioner can be installed by only one person.

Figure 2:
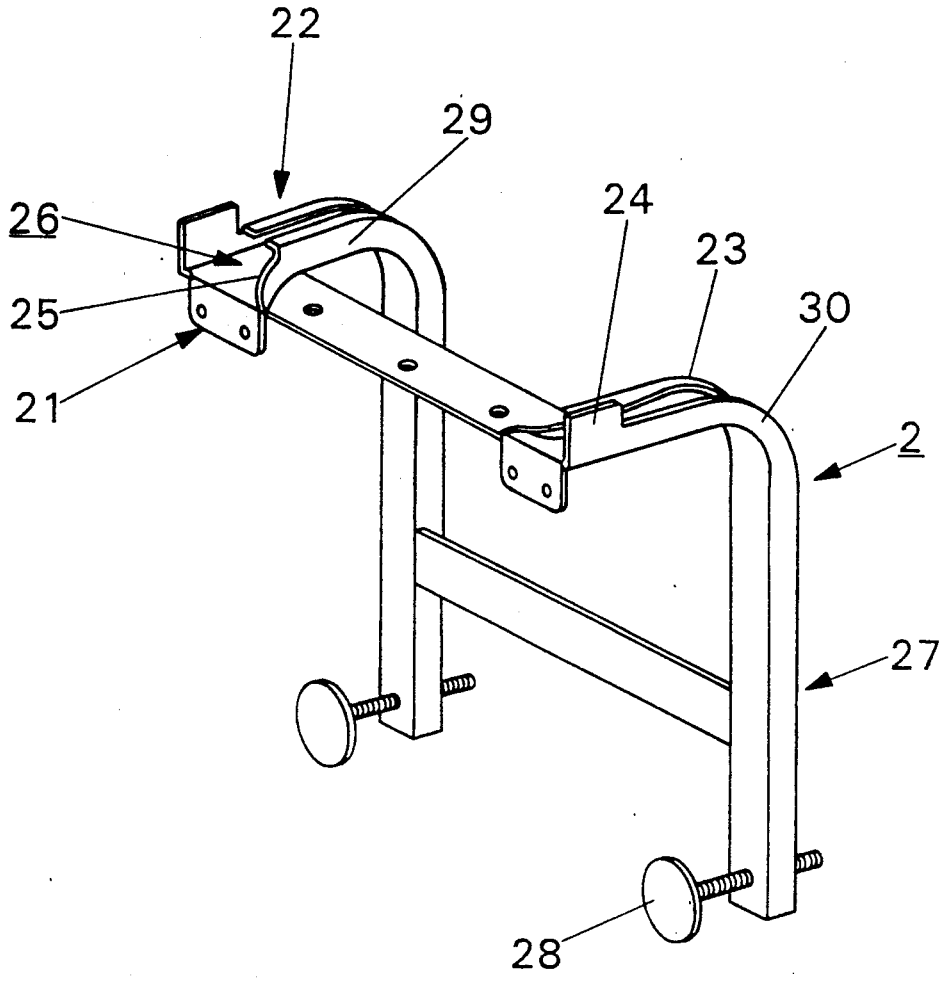
FIG. 2 is a perspective view of a bracket according to the invention.

FIG. 2 shows a bracket for mounting the air conditioner of FIG. 1 on a window frame of a building. The bracket 2 of FIG. 2 comprises a fixing portion 21, an upper guiding portion 22, and a lower guiding portion 27. In the embodiment, the fixing portion 21 is composed of two plate pieces which project downwardly from the front end of the upper guiding portion 22. The upper guiding portion 22 comprises two rails 29 which extend horizontally and in a parallel manner. The rails 29 have a shape of a rectangular pipe in which a slit 23 is formed at the top wall. The distance between the slits 23 coincides with that between the projections 15 of the air conditioner of FIG. 1. The upper guiding portion 22 further comprises a pair of regulation plates 24 which face each other and protrude upwardly from the front end of each rail 29, so that the distance between the plates 24 fits the width of the bod 1 of the air conditioner of FIG. 1 (i.e., the width of the side wall 13*a*). In the embodiment, each of the plates 24 is formed as an extension of an outer side wall of each rail 29. At the front end region of the upper guiding portion 22, the inner side wall of each rail 29 obliquely extends to form a guiding piece 25 in such a manner that, when advancing toward the front end of the upper guiding portion 22, the distance between the guiding piece 25 and the opposing plate 24 is gradually increased. As a result, each combination of the guiding pieces 25 and the regulation plates 24 constitutes a guiding entrance 26.

Each of the rails 29 extends downwardly through quadrant portions 30 to constitute the lower guiding portion 27 which extends vertically. Since the two rails 29 are commonly owned by both the upper guiding portion 22 and lower guiding portion 27, the sectional shape of the lower guiding portion 27 is identical with that of the upper guiding portion 22, and the slit 23 is formed also in the lower guiding portion 27. Two adjusting bolts 28 are rotatably attached at the lower guiding portion 27. As shown in FIG. 2, the adjusting bolts 28 protrude horizontally to the side of the upper guiding portion 22, and the degree of the protrusion of the bolts 28 can be easily changed by rotating them. The rails 29 are rigidly connected by two plates so that the predetermined distance between the slits 23 is maintained.

Figure 4A:
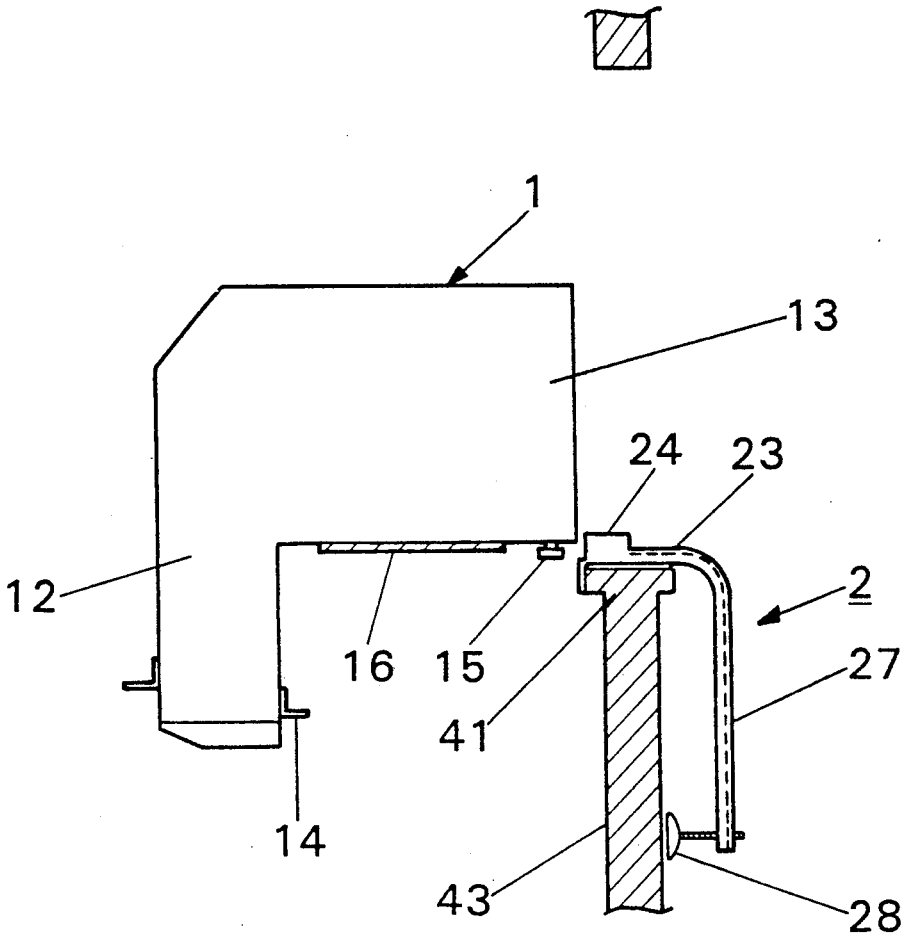
FIGS. 4A and 4B illustrate the manner of installing the air conditioner of FIG. 1 using the bracket of FIG. 2.
Figure 4B:
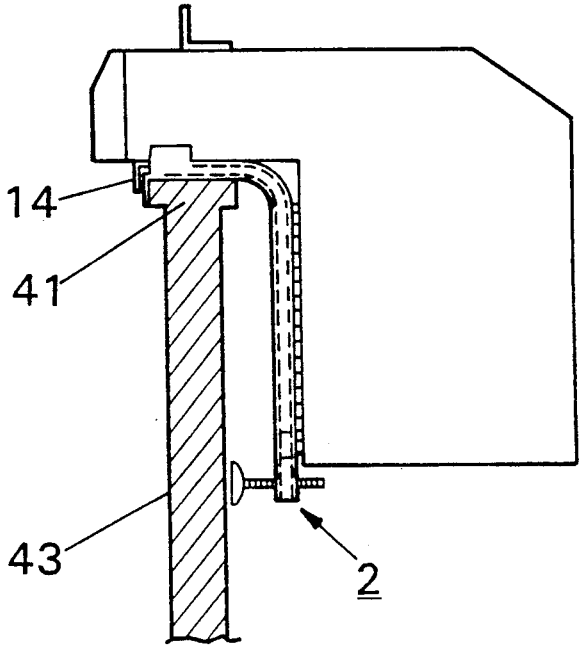

The manner of installing the air conditioner of FIG. 1 on a window frame with using the bracket of FIG. 2 will be described with reference to FIGS. 4A and 4B. First, the bracket 2 is attached to the window frame 41 in such a manner that the engagement member 14 engages with the indoor edge of the lower unit of the window frame 41. As a result, the upper guiding portion 22 seats on the lower unit of the window frame 41, and the lower guiding portion 27 elongates downwardly along the outdoor side of the wall 43. The tilt of the bracket 2 is adjusted by rotating the adjusting bolts 28. Then, the worker standing indoors lifts the body 1 of the air conditioner as shown in FIG. 4A, and the lower end of the body 1 is rested on the upper guiding portion 22 so that the two projections 15 are placed in the guiding entrances 26, respectively. This can be easily done because the outdoor unit 13 can be sandwiched by the regulation plates 24 and the projections 15 are guided into the guiding entrance 26 by the guiding pieces 25. Thereafter, the body 1 is pushed toward the outdoor side, thereby introducing the projections 15 into the rails 29. In this sate, the shaft portion 15*a* of each projection 15 is inserted into the slit 23. That is, the projections 15 engage with the rails 29, respectively.

The body 1 of the air conditioner is further pushed toward the outdoor side to slide on the upper guiding portion 22. Since the projections 15 remain to engage with the bracket 2, there is no danger of dropping the body 1 even when the worker lets the body 1 free. With the advancement of the projections 15 in the quadrant portions 30, the body 1 gradually rises. After the projections 15 reaches the lower guiding portion 27, the body 1 begins to fall along the lower guiding portion 27. During this fall, the worker may draw the body 1 toward him (i.e., toward the indoor side) so that the brake pads 16 are forcedly and slidingly contacted with the inner surface of the lower guiding portion 27. Hence, by adjusting the drawing force (i.e., the friction caused between the brake pads 16 and the lower guiding portion 27), the speed of the body 1 can be freely controlled, resulting in that the air circuit unit 12 softly lands on the upper guiding portion 22. This can prevent the window frame, air conditioner, bracket, etc. from being damaged, and also can prevent the hands of the worker from being pinched.

If necessary, the tilt of the air conditioner disposed on the bracket 2 may be adjusted by rotating the adjusting bolts 28. Then, the bracket 2 is nailed or screwed to the window frame 41 to be firmly fixed thereto. In this way, the air conditioner can be installed safely and surely by one person.

Figure 3:
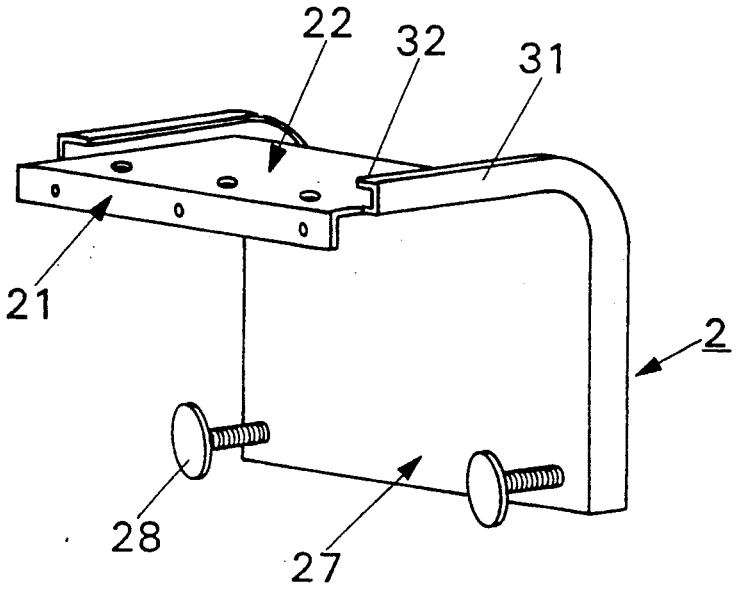
FIG. 3 is a perspective view of another bracket according to the invention.

Another bracket according to the invention is shown in FIG. 3. In the bracket 2 of FIG. 3, the upper and lower guiding portions 22 and 27 are composed of a curved plate. The side edges of the curved plate are bent inwardly to form channel-like rails 32 which face each other. When the air conditioner of FIG. 1 is installed using the bracket of FIG. 3, the projections 15 engage with the rails 32. The bracket of FIG. 3 has a very simple structure wherein most of the major elements including the fixing portion 21 are formed in one body.

Since both the brackets shown in FIGS. 2 and 3 are so constructed that the rails 29 or 32 which function as an engagement means are formed by bending the outer edge of upper and lower guiding portions 22 and 27, these brackets have an effectively increased mechanical strength.

Figure 5:
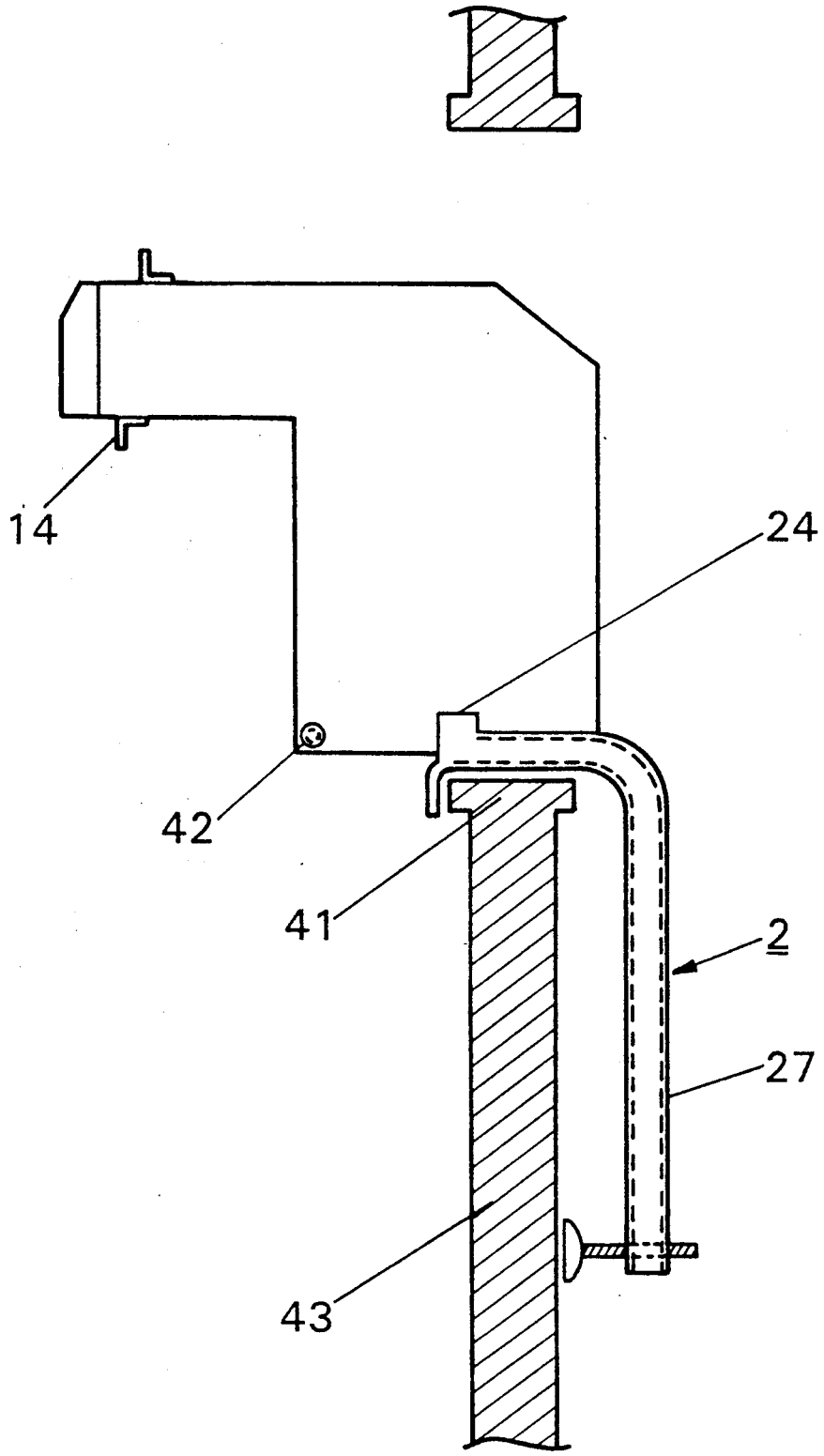
FIG. 5 illustrates the manner of installing another air conditioner according to the invention.

Another air conditioner according to the invention is shown in FIG. 5. The air conditioner of FIG. 5 comprises engagement projections 42 which are disposed respectively on the side walls **13*b* and 13*c* (FIG. 1**).

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. In a one-package type air conditioner for mounting on a window frame comprising:

an air circuit unit which extends horizontally to be positioned indoors;

an outdoor unit which extends downwardly from a rear end portion of said air circuit unit;

an elongate member attached to said air circuit unit, said elongate member protruding downwardly from a lower surface of said air circuit unit for engagement with a lower portion of the window frame; and at least one engagement member extending outwardly from a side wall of said outdoor unit for engagement with a bracket mounted onto the window frame.

2. An air conditioner according to claim 1, wherein said engagement member has an enlarged top end.

3. An air conditioner according to claim 1, wherein said air conditioner comprises two engagement members, each engagement member extending outwardly from a side wall of said outdoor unit.

4. An air conditioner according to claim 1, wherein said engagement member has an enlarged end.

5. An air conditioner according to claim 1, wherein said air conditioner further comprises at least one elongate pad which is attached to said side wall, said elongate pad being disposed respectively over said engagement member.

6. An air conditioner according to claim 5, wherein said elongate pads are made of synthetic rubber.

7. A bracket for mounting an air conditioner according to claim 1 on a window frame, comprising:

a fixing portion which engages with a window frame;

a lower guiding portion which extends vertically;

an upper guiding portion which is disposed between said fixing portion and the upper end of said lower guiding portion; and at least two adjusting means which are attached to said lower guiding portion to protrude horizontally therefrom, the degree of the protrusion of said adjusting means being adjustable.

8. A bracket according to claim 7, wherein said bracket further comprises two regulation plates which protrude upwardly from each of both side ends of said fixing portion.

9. A bracket according to claim 7, wherein said upper guiding portion and said lower guiding portion are connected by a connecting portion having an arc-like section.

10. A bracket according to claim 9, wherein rails are disposed at the outer side edges of said upper guiding portion, connecting portion and lower guiding portion, said rails having a reverse-L section and opposing to each other.

11. A bracket according to claim 9, wherein said upper guiding portion, connecting portion and lower guiding portion are composed of a pair of rails which are separated from each other by a predetermined distance, thereby forming said portions into one body.

12. A bracket according to claim 9, wherein two guiding pieces are disposed at the front end of said upper guiding portion, each of said guiding pieces protruding upwardly from the upper face of said upper guiding portion and facing respectively to said regulation plates, the distance between one of said guiding pieces and the corresponding one of said regulation pieces being gradually narrowed.

* * * * *